US006662486B2

(12) United States Patent
Komberger

(10) Patent No.: US 6,662,486 B2
(45) Date of Patent: Dec. 16, 2003

(54) UNIVERSAL GUN SIGHT MOUNT, ADJUSTABLE FOR RANGE

(76) Inventor: Franz Komberger, 427 Hamill Rd., Indiana, PA (US) 15701

( * ) Notice: Subject to any disclaimer, the term of this patent is extended or adjusted under 35 U.S.C. 154(b) by 0 days.

(21) Appl. No.: 10/337,973

(22) Filed: Jun. 15, 2002

(65) Prior Publication Data

US 2003/0131518 A1 Jul. 17, 2003

Related U.S. Application Data

(60) Provisional application No. 60/298,505, filed on Jun. 18, 2001.

(51) Int. Cl.[7] ..... F41G 1/06
(52) U.S. Cl. ..... 42/138; 42/135
(58) Field of Search ..... 42/111, 135, 136, 42/137, 138

(56) References Cited

U.S. PATENT DOCUMENTS

| | | | | | |
|---|---|---|---|---|---|
| 32,899 | A | * | 7/1861 | Sharps | 42/138 |
| 280,484 | A | * | 7/1883 | Kelton | 42/137 |
| 533,003 | A | * | 1/1895 | Dieffenbach | 42/138 |
| 592,740 | A | * | 10/1897 | Kennedy | 42/138 |
| 658,709 | A | * | 9/1900 | Fischer | 42/138 |
| 732,075 | A | * | 6/1903 | Hepburn | 42/136 |
| 852,152 | A | * | 4/1907 | Albee | 42/136 |
| 937,244 | A | * | 10/1909 | Kennedy | 42/138 |
| 1,070,767 | A | * | 8/1913 | Brauning | 42/138 |
| 1,455,071 | A | * | 5/1923 | Browning | 42/138 |
| 2,345,553 | A | * | 4/1944 | Brown et al. | 42/136 |
| 4,977,676 | A | * | 12/1990 | Toupin | 42/138 |

* cited by examiner

*Primary Examiner*—Michael J. Carone
*Assistant Examiner*—Gabriel S. Sukman
(74) *Attorney, Agent, or Firm*—Klaus J. Bach

(57) ABSTRACT

In a gun sight mount including a base for mounting on a weapon, a universal mounting rail is pivotally mounted on a base and the mounting rail and base are provided with means for quickly adjusting the mounting rail with the gun sight to different predetermined angles for predetermined target distances depending on the weapon and the munitions being fired from the weapon.

4 Claims, 2 Drawing Sheets

UNIVERSAL GUN SIGHT MOUNT, ADJUSTABLE FOR RANGE

This application claims the Benefit of Provisional application No. 60/298,505 filed Jun. 18, 2001.

BACKGROUND OF THE INVENTION

The invention relates to a universal gun sight mount, which is readily adjustable for firing at certain ranges.

There are electronic and optical gun sights available on the market. However, none of these sights has a quick range adjustment; a user has to "sight in" the gun sight for a particular distance, and for any other distance, the user has to "judge" up or down on the target to hit at the desired point.

This is especially hard for law enforcement personnel, who have to hit a target at quickly changing distances and at specific points with "less lethal munitions".

The object of this invention is to provide a simple, universal gun sight mount, which allows a quick and accurate adjustment of the sight for quickly changing conditions.

SUMMARY OF THE INVENTION

In a gun sight mount including a base for mounting on a weapon, a universal mounting rail is pivotally mounted on one end of the base whose opposite end is provided with means for quickly adjusting the sight mounting rail to different predetermined stops for predetermined distances based on the weapon and munitions being fired from that weapon.

The universal gun sight mount is intended mainly for large-caliber, low-velocity weapons and munitions, e.g.—37 mm and 40 mm, and a variety of launchers and munitions available for use by law enforcement and military personnel.

The mount is fitted on top of a gun, usually onto the frame or barrel of the gun. The sight, particularly a gun sight that is an electronic or a "red dot" sight, fits onto a universal standard rail mounted on the base. The user will "sight in" the weapon at 20 meters. If the target is out to 50 meters, the user can quickly adjust the sight to 50 meters. The user quickly adjusts the sight by pulling out a locking knob and adjusting levers for moving the rail to the desired range.

PREFERRED EMBODIMENTS

Figure 1:
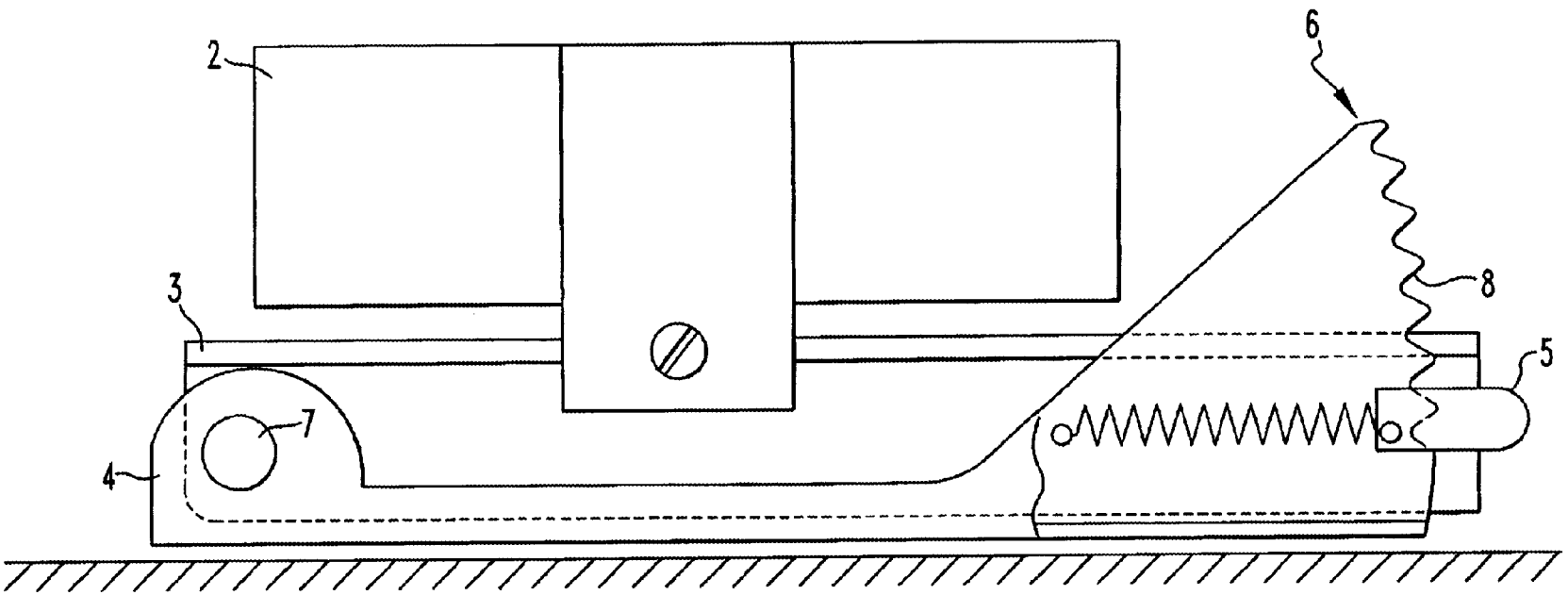
FIG. 1 is a side view of the gun sight and mount, mounted on a weapon.

The gun sight mount includes a base 4, which is fixed on top of the weapon 1. A rail 3 for mounting a scope or a sight 2 is pivotally fixed to the base 4 by a hinge pin 7 and held in place by a locking mechanism 6.

The locking mechanism 6 includes a locking knob 5. The locking mechanism is set by pulling the knob 5 out of the notches 8 formed on the base 4 and moving the rail 3 up or down to the desired notch 8, whereupon the knob 5 is re-engaged with the desired notch 8. The notches 8 are machined according to the ballistic values of the particular munitions and caliber given.

The range adjustments are simply set by sighting in at a specific yardage and adjusted accordingly using the locking mechanism 6 with the preset notches 8.

Figure 3:
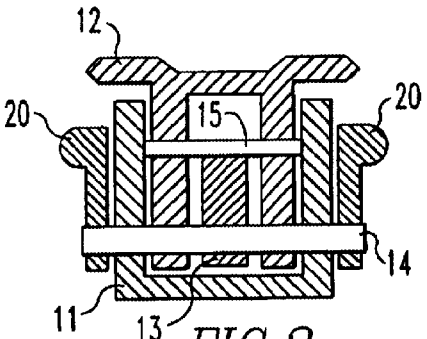
FIG. 3 is a cross-section of the mount.
Figure 2:
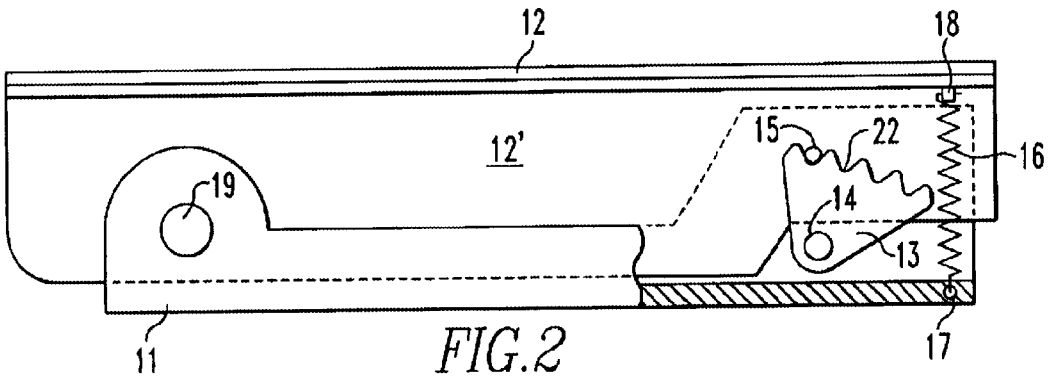
FIG. 2 is a side view of a particular embodiment of the gun sight mount.

In another embodiment, shown in FIGS. 2 and 3, the universal gun sight mount includes a mount base 11, which may be mounted on a gun frame or gun barrel. A sight mounting rail 12 is pivotally attached to the front of the mount base 11 by a rail hinge pin 19, which extends laterally through the mount base 11 and the rail 12.

Pivotally mounted at the bottom of the mount base 11 are levers 20, pivotally mounted by a hinge pin 14, which extends laterally through the mount base 11.

A cam 13, disposed between opposite flanges 12' of the rail 12, is fixed to the hinge pin 14 so that pivoting of the levers 20 will rotate the cam 13. The cam's outer radial surface is formed so as to create recesses 22 located with predetermined spacings at distances from the hinge pin 14, which increase from recess to recess. The recesses 22 receive a stop pin 15, which extends laterally through the rail 12. A tension spring 16 is connected to pins 17 and 18, mounted to the mount base 11 and the rail 12, respectively, and provides tension to maintain a firm engaging force between the stop pin 15 and the cam 13. Pivoting the levers 20 causes the cam 13 to pivot, which in turn places the stop pin 15 in a different recess. The recesses are spaced at radially different distances from the hinge pin 14, thus raising or lowering the sight upon pivoting of the cam 13. The cam 13 is selected depending on the type of ammunition to be used.

Figure 4:
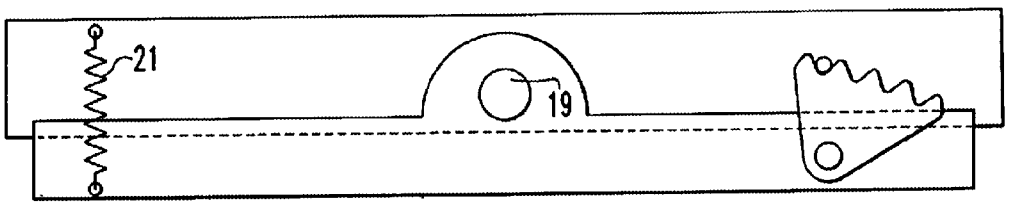
FIG. 4 is a side view of another embodiment of the mount.

FIG. 4 shows another embodiment similar to that shown in FIG. 2, however the rail hinge pin 19, around which the rail pivots relative to the mount base 11, is located in this case near the center of the base.

The spring is arranged in this embodiment at the end of the mount base 1, opposite the cam 13 on the opposite side of the rail hinge pin 19 and is a compression spring 21.

The radially spaced distances on the cam are predetermined based on the weapon and the munitions being fired from the weapon, i.e.—there are different cam structures for different applications.

The cams and stop pins are preferably hardened or made of a superior grade metal or alloy so as to reduce wear resulting from use and eliminating the need for frequent sighting in.

What is claimed is:

1. A universal gun sight mount for attachment to a gun, said gun sight mount comprising:

a universal base for mounting on a gun frame or barrel, a gun sight mounting rail provided with spaced flanges and being pivotally supported on said base for supporting a gun sight, range adjusting means comprising a cam structure pivotally supported on said base between said flanges and having recesses located in spaced relationship along the outer radial surface, which is curved such that its radial distance from the pivot point changes over the circumferential extent of said outer radial surface, and a stop pin extending laterally through said mounting rail and being received in one of said recesses of said cam structure for adjusting the pivot position of said gun sight mounting rail and for holding said gun sight mounting rail in a particular pivot position.

2. A universal gun sight mount according to claim 1, wherein a spring is disposed between said rail and said base providing engagement tension between said stop pin and said cam structure, and a pivot pin extends through said base and is fixed to said cam and levers are connected to said pivot pin on either side of said base, for rotating said cam for adjusting the range of said sight.

3. A universal gun sight mount according to claim 2, wherein the pivot point of said rail is located near one end of said base and said spring is located at the opposite end and is a tension spring.

4. A universal gun sight mount according to claim 2, wherein said pivot point of said rail is located in the center area of said rail, said cam structure is disposed at one end of said rail and said engagement spring is a compression spring arranged at the opposite end of said rail.

* * * * *